United States Patent [19]

Moss

[11] Patent Number: 4,898,171

[45] Date of Patent: Feb. 6, 1990

[54] STAY-IN-PLACE PACIFIER

[76] Inventor: Ernest Moss, 200 River Court Pkwy., Atlanta, Ga. 30328

[21] Appl. No.: 139,460

[22] Filed: Dec. 30, 1987

[51] Int. Cl.[4] ..... A61J 17/00

[52] U.S. Cl. ..... 606/236

[58] Field of Search ..... 128/359, 360

[56] References Cited

U.S. PATENT DOCUMENTS

| | | | |
|---|---|---|---|
| 4,403,613 | 9/1983 | Panicci | 128/360 |
| 4,447,164 | 5/1984 | Berndt | 374/162 |
| 4,545,378 | 10/1985 | Chrones | 128/360 |
| 4,554,919 | 11/1985 | Hubert | 128/360 |
| 4,577,632 | 3/1986 | Grasset | 128/360 |

*Primary Examiner*—Stephen C. Pellegrino
*Attorney, Agent, or Firm*—Edwin D. Schindler

[57] ABSTRACT

A pacifier is disclosed which includes a shield protector with a conventional, hollow nipple attached to, and extending from, one side of the shield protector. The shield protector should preferably be of a size which is sufficiently large so as to prevent the baby or infant from accidentally ingesting the same. The side of the shield protector opposite to the side having the nipple portion, includes a handle portion, preferably having a substantially cylindrical shape, which is capable of insertion into, and removal from, the hollow portion of the nipple of the pacifier by passage of the handle portion through an opening in the protective shield. The handle of the invention, in a preferred embodiment, further includes removable fastening means, such as a hook-loop material for attachment to a ribbon, suspension support cord, or other support device.

4 Claims, 1 Drawing Sheet

STAY-IN-PLACE PACIFIER

BACKGROUND OF THE INVENTION

1. Technical Field of the Invention

The present invention generally relates to a pacifier for infants and babies. More particularly, the present invention relates to a pacifier having a protective shield, which may not be ingested by a baby or infant, which includes a nipple on one end of the protective shield and a handle at the opposite end of the shield. The handle of the invention may, at the option of an adult, be stored inside the nipple portion of the pacifier or removed therefrom. The handle, as will be explained in greater detail hereinafter, may be designed for easy grasping by an adult and may include removable attachment means such as, hook-look means, for easy attachment to, and removal from, a suspender cord or the like.

2. Description of the Prior Art

Infant and baby pacifiers, presently known to the priar art, generally include a mouth protective shield having a nipple on one side and a handle on the opposite side. Additionally, some prior art devices have merely an opening, without a handle, on the side opposite to the side having the nipple, while other devices have a closed surface on this opposite side. Prior art devices of the foregoing types are generally disclosed in U.S. Pat. Nos. 4,403,613, issued Sept. 13, 1983, to Panicci; 4,447,164, issued May 8, 1984, to Berndt; 4,545,378, issued Oct. 8, 1985, to Chrones; 4,554,919, issued Nov. 26, 1985, to Hubert; and, 4,577,632, issued Mar. 25, 1986, to Grasset.

The usual reasons for designs of the foregoing types are so that a handle is available to grasp the pacifier or to tie it to a string. Alternatively, some pacifier designs omit a handle portion from the pacifier so that a baby cannot accidentally pull the pacifier from its mouth. A drawback of this latter design is that it also prevents grasping of the pacifier, on its backside, by an adult, or tying the pacifier to a ribbon, etc., by the adult so that the pacifier cannot be thrown to the ground by the baby or infant. One device disclosed by prior art includes a pacifier having just an opening on the side opposite to that of the nipple portion. Such a design has no readily apparent benefit, as would exist with the device of the present invention.

In addition, when pacifiers, such as those of the prior art, are supplied with an unobstructed opening in the opposite side to the nipple side, the infant may insert its fingers in the opening thereby accidentally removing the pacifier from its mouth or having its fingers caught in the opening.

The prior art, while providing several pacifiers of varying constructions, fails to provide a pacifier whereby a parent can select, on a continuing basis, whether to have the handle portion of a pacifier either extended or recessed, depending upon the circumstances of the moment. The art further fails to include means for the ready attachment and removal of such a pacifier from a suspender support cord or other support.

SUMMARY OF THE INVENTION

Accordingly, it is an object of the present invention to provide a pacifier device for an infant which permits an adult to continually decide whether the handle portion of such a pacifier shall be extended or recessed.

It is a further object of the invention to provide a pacifier, having a handle portion, which may be readily attached and detached from a support cord or other support, irrespective of whether the handle portion of the pacifier is in an extended or recessed position.

It is, yet a further object of the present invention to provide a pacifier for use by a baby or infant which cannot be unintentionally grasped by the baby or infant so as to possibly cause harm to the baby or infant.

It is still a further object of the present invention to provide a pacifier device which may be economically manufactured.

It is an additional object of the present invention to provide a pacifier device which overcomes the disadvantages inherent in the prior art.

The foregoing and related objects are achieved by the pacifier device of the present invention in which the invention includes a pacifier having a shield protector with a conventional nipple attached to, and extending from one side of the shield protector. The shield protector should preferably be of a size which is sufficiently large so as to prevent the baby or infant from accidentally ingesting the same.

The side of the shield protector opposite to the side having the nipple portion, includes a handle portion which is capable of insertion into, and removal from, the hollow portion of the nipple or the hollow portion of the shield protector of the pacifier.

The handle or the attachment means of the invention, in a preferred embodiment, further includes removable fastening means for attachment to a ribbon, suspension support cord, or other support device. Alternatively, the removable fastening means may be attached to the protective shield.

Both embodiments of the invention, and such similar embodiments, it will be understood, accomplish a similar purpose and, will be understood, as being included within the scope of the present invention. Such removable fastening means are preferably hook-loop fastening means, commonly known by the registered trademark Velcro. In this fashion the pacifier may be simply and easily released from a support by a parent, but not accidentally or unintentionally removed by an infant or baby.

In this embodiment it would be possible for both legs of the hook-loop strip to be formed around a support and to be fastened to one another in order to present a flat, flexible handle which be would difficult for an infant to grasp. Such a design would prevent an infant from sticking its fingers into a conventional pacifier loop, thereby pulling the pacifier from its mouth. Additionally, the flexible handle design embodiment of the present invention could allow a baby to lie with the pacifier in its mouth directly against a mattress, without the discomfort which would otherwise be caused by a conventionally formed rigid handle, as disclosed by prior art devices.

More particularly, in a preferred embodiment of the invention, the handle support portion of the present invention is formed by means of an integral construction with the pacifier assembly, thereby ensuring a strong resistance to tearing or breaking when a sturdy hook-loop material is passed around a support bar to form the handle.

In addition, the handle portions of the present invention may be made of, or include, a flexible, resilient material so that the handle of the invention may be resiliently held within the opening of the pacifier nipple or within the protective shield by such a stretch, flexible and resilient material or similar retention means.

The invention will now be described in further detail with reference being made to the drawing figures. It should, however, be recognized that the accompanying drawing illustrates but a single embodiment of the present invention and is not intended as a definition of the limitations or scope thereof.

BRIEF DESCRIPTION OF THE DRAWING

In the drawing, wherein similar reference numerals denote similar features throughout the several views.

DETAILED DESCRIPTION OF THE DRAWING

Figure 1:
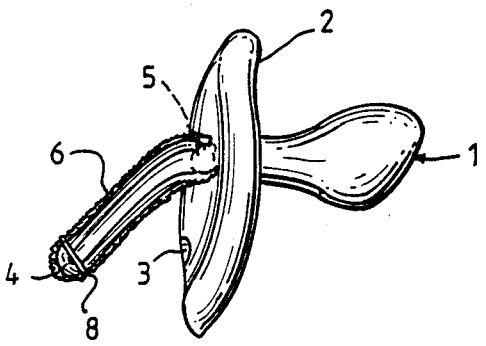
FIG. 1 illustrates a side view of the pacifier of the present invention showing a handle extending from the inner, hollow area of a nipple.
Figure 2:
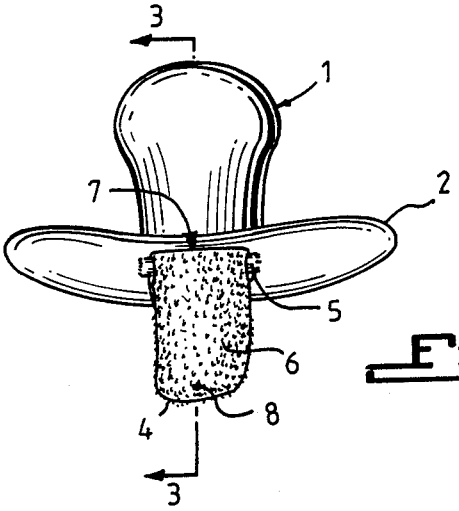
FIG. 2 illustrates a top view of the pacifier of the present invention showing the handle of FIG. 1 extending from the inner area of the nipple.
Figure 3:
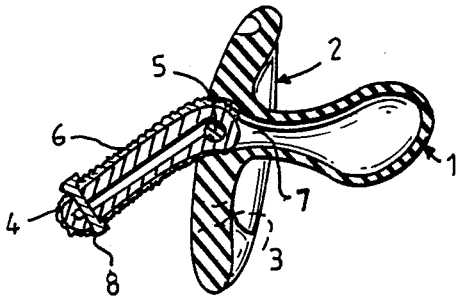
FIG. 3 is a sectional view taken along the line 3-3 of FIG. 2, showing a hook-loop handle of the present invention fastened around an outer support bar and extending outwardly from the hollow, inner area of the nipple of the pacifier.

Turning now, in detail, to the drawing figures, the present invention, as illustrated in FIGS. 1-3 is shown as including a nipple 1 attached to a mouth protective shield 2, with a hole 3 therethrough. A handle support bar 5 is attached to shield 2, which allows for the fastening of a flexible strip such as, for example, a hook-look material 6 there about, thereby forming a handle 4 which may be fastened by sewing, gluing, riveting or similar means, e.g., item 8.

Referring, in particular, to FIG. 3, handle 4 of the invention is illustrated as being capable of being slidably inserted in, and retracted from, an inner, hollow surface area 7 of nipple 1.

Figure 4:
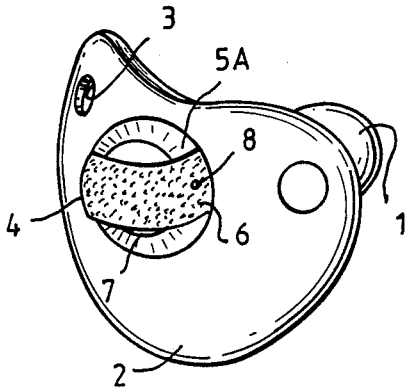
FIG. 4 illustrates a perspective view of the pacifier of the invention showing an additional means of attaching the hook-loop cooperable mating means used in conjunction with the invention.

FIG. 4 shows yet another embodiment of hook-loop strip 6, which forms a low-profile handle 4, which allows for a mating hook-loop attachment and which partially obstructs the nipple opening. This handle can be constructed across an extending support flange 5A and the entire assembly can then be pushed and recessed into opening 7 so that a baby cannot readily insert its finger into such opening. By contrast, however, an adult can easily extract the handle of the pacifier by inserting his finger past the obstruction and into the opening in order to flip the handle out.

Figure 5:
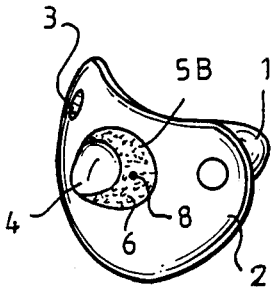
FIG. 5 illustrates a perspective view of the pacifier of the present invention showing, yet, an additional mode of attaching the hook-loop cooperable mating means; and, FIG. 6 is a sectional view of the pacifier of the present invention taken along the line 3—3 of FIG. 2, with the exception being that the handle support bar of the invention is shown as being located within the hollow, inner storage area of the nipple so that the handle of the pacifier may be resiliently extended from the inner area of the nipple.

FIG. 5 illustrates hook-loop strip 6 being fastened concentrically around a closed support flange 5B on the back of protective shield 2. This makes it difficult for a baby to grasp the handle, but allows for cooperable mating and/or grasping of handle 4 by an adult's fingertips.

Figure 6:
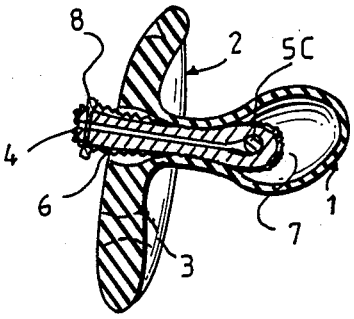

Finally, FIG. 6 illustrates an inner support bar 5C with handle 4 attached therearound. In a preferred embodiment of the present invention, support bar 5C would be made of a resilient material or, alternatively, handle 4 might be constructed of a resilient material so that handle 4 could be pulled from its inner storage area 7 for its intended use and, thereafter, be returned to storage area 7 inside nipple 1 by self-retraction.

While only several embodiment of the present invention have been shown and described, it will be obvious to those skilled in the art that many modifications of the present invention are possible without departing from the spirit and scope thereof.

What is claimed is:

1. A pacifier for babies and infants, comprising:

a shield protector with a hole therethrough;

a nipple attached to a side of said shield protector so that said nipple substantially covers the hole of said shield protector, said nipple having a hollow storage area which is accessible through the hole of said shield protector; and a handle resiliently attached to said hollow storage area of said nipple, said handle being continually capable of resilient storage within the hollow storage area of said nipple and being continually capable of removal or extension therefrom, by passage of said handle through the hole of said shield protector.

2. The pacifier according to claim 1, wherein said handle is made of a hook-loop material.

3. The pacifier according to claim 1, wherein said protective shield includes cooperable hook-loop mating means.

4. The pacifier according to claim 1, wherein said handle is made of a resilient material.

* * * * *